US005343189A

United States Patent [19]

Alley, Sr.

[11] Patent Number: 5,343,189

[45] Date of Patent: Aug. 30, 1994

[54] SIGNAL ASSEMBLY REMOVABLY ATTACHABLE TO HANDLE OF SKI TOW ROPE

[76] Inventor: Ronald S. Alley, Sr., 5100 Old Alabama Rd., Alpharetta, Ga. 30202

[21] Appl. No.: 974,136

[22] Filed: Nov. 10, 1992

[51] Int. Cl.[5] ..... G08B 1/08

[52] U.S. Cl. ..... 340/539; 340/573; 340/693; 340/548; 340/984

[58] Field of Search ..... 340/539, 573, 548, 984, 340/693

[56] References Cited

U.S. PATENT DOCUMENTS

| | | | |
|---|---|---|---|
| 3,018,474 | 1/1962 | Cluck et al. | 340/366 |
| 3,103,005 | 9/1963 | Hills | 340/286 |
| 3,734,230 | 5/1973 | Tanaka | 180/99 |
| 3,758,736 | 9/1973 | Tanaka | 200/157 |
| 3,938,613 | 2/1976 | Raborn | 180/99 |
| 4,058,105 | 11/1977 | Schellin et al. | 123/198 |
| 4,483,683 | 11/1984 | Alley, Sr. | 441/69 |
| 4,577,185 | 3/1986 | Andersen | 340/573 |
| 4,583,084 | 4/1986 | Henderson et al. | 340/573 |
| 4,689,611 | 8/1987 | Franklin | 340/539 |
| 4,792,798 | 12/1988 | Wilowski | 340/573 |
| 4,934,972 | 6/1990 | Shumway et al. | 441/69 |
| 4,964,821 | 10/1990 | Tafoya | 440/38 |
| 5,132,697 | 7/1992 | Tan | 343/718 |

*Primary Examiner*—Donnie L. Crosland
*Attorney, Agent, or Firm*—Kennedy & Kennedy

[57] ABSTRACT

A removably attachable casing for a ski tow signal transmitter to alert an operator of a boat pulling a skier that the skier has fallen, with an upper housing and a lower housing that surround and captures a handle of a ski tow rope in a passageway while being matingly joined together. The removably attachable casing facilitates easy installation of the safety device in different boats or rapid replacement of a broken handle or ski tow rope.

10 Claims, 2 Drawing Sheets

SIGNAL ASSEMBLY REMOVABLY ATTACHABLE TO HANDLE OF SKI TOW ROPE

TECHNICAL FIELD

The present invention relates to ski tow signaling devices. More particularly, the present invention relates to a signaling device that is removably attachable to a handle of a ski tow rope.

BACKGROUND OF THE INVENTION

Recreational use of water facilities such as lakes, reservoirs, and the oceans, has increased in recent years. This increase in use arises from a number of factors including relatively inexpensive power and sail boats, additional leisure time, and easier, more rapid access to boating facilities. Recreational boating activities include cruising, swimming, fishing and water skiing. These activities involve a number of persons, and some water facilities have become crowded.

Crowded water facilities pose risks to persons using the facilities, and especially to water skiers. A skier bobbing in the open water typically is either preparing to ski or after falling, is waiting for the ski boat to return. The skier in the water is especially at risk from other boaters. The skier is low in the water; the other boaters are above the water. Glare, speed, and inattention may prevent the boater from seeing the skier. It is important therefore for an operator of a boat pulling a skier to learn quickly that the skier has fallen. The operator may then circle back to pick up the skier. The boat also provides a larger structure that may be seen at a distance to alert other boaters of the presence of a skier in the water.

Signaling devices have been developed to alert the operator of the ski boat that the skier has fallen into the water. For example, U.S. Pat. No. 4,483,683 issued to Alley, Sr. describes a ski tow rope which fastens in a conventional manner to the ski boat. The distal end of the rope carries a handle provided with a radio signal transmitter and a trigger wholly contained within the handle. Depressing the trigger stops the transmitter from sending a signal to a receiver in the boat. Releasing the trigger, such as when the skier falls into the water, activates the transmitter to send the signal. Upon receipt of the signal, the receiver alerts the operator by a noise or light alarm. For example, a strobe light mounted high in the boat on the windshield alerts both the operator and other operators of nearby boats.

U.S. Pat. No. 4,689,611 issued to Franklin describes an alarm and communication system for water skiers pulled by power boats. A radio receiver receives a constantly emitted signal from a transmitter housed in a handle at the ski rope or attached to a life vest worn by the skier. An alarm switch in the receiver provides a closed contact in the absence of the receipt by the receiver of a signal, such as when the skier releases the handle. Submergence of the antenna and the increasing distance between the boat and the skier results in a diminished signal, such that the alarm switch then closes to activate an alarm. Such device however, has drawbacks which may trigger false alarms. The transmitter is always operating during use, which depletes the power supply. Weak or low batteries may diminish the power of the transmitted signal. A diminished signal may result in the alarm being triggered in the boat, yet the skier would be properly skiing. Also, while the skier is preparing to ski, the antenna is covered by water.

This too diminishes the strength of the radio signal and may activate the alarm. To avoid inadvertent activation, the receiver must first be switched off, and thereafter activated so the alarm system can operate. Such on/off switching may prove to be annoying or perchance forgotten, so that the skier is skiing with a false sense of security relying on an alarm that is not activated.

While accomplishing the intended purpose, such signal devices have drawbacks which discourage their use. The electronics for the receiver and transmitter are costly. The transmitter is build-in to the handle of the ski tow rope. Should the rope or the handle break, the signal device cannot be used. Repair of the device may require returning the transmitter and rope to the manufacturer. The attempt to overcome this problem by positioning the alarm transmitter on the skier leads to possible false alarms or unintentional non-use of the alarm device, as discussed above.

Accordingly, there is a need in the art for a radio signal transmitter that is releasably attachable to the handle of a ski tow rope, thereby permitting repair of a broken rope or handle while keeping the transmitter in close proximity to the receiver.

SUMMARY OF THE INVENTION

The present invention overcomes the problems in the art by providing a removably attachable signal transmitter for a handle of a ski tow rope. Generally described, the present invention provides a casing releasably attachable to the handle of a ski tow rope for a radio signal transmitter. A switch controls whether the transmitter sends a signal. The switch is preferably biased off, so that upon release of the switch, the transmitter is activated to signal a receiver.

More particularly described, the casing comprises an upper housing that matingly joins to a lower housing. The housings define a passageway through the casing at a first end. The handle of the ski tow rope is captured in the passageway when the upper and lower housings are joined together.

More particularly described, a clip removably attaches to the casing at a first end. The clip completes a circuit which holds the switch in a first position to stop the transmitter from sending the signal. The clip includes a tab that projects from the clip and that engages a detent in the casing. An electrical contact in the detent communicates through a second electrical contact in the clip to close a circuit which prevents the transmitter from operating. One end of a lanyard attaches to the clip, and a distal end removably attaches to the skier. When the skier falls or becomes separated from the handle of the ski tow rope, the lanyard is thereby pulled by the skier. The clip is sharply tugged and is detached from the housing. The circuit is opened and in response the switch then moves to the second activated position. In the second position, a second circuit is closed, thereby activating the transmitter. The transmitter then sends the signal to the receiver for alerting the operator of the boat.

Accordingly, it is an object of the present invention to provide a radio transmitter that is removably attachable to a handle of a ski tow rope.

It is another object of the present invention to provide a removably attachable signaling device responsive to a skier falling off skies into the water.

It is another object of the present invention to provide a signaling device for a skier to communicate with a boat operator.

It is another object of the present invention to provide a signaling device to alert other boat operators to the presence of a nearby water skier.

It is another object of the present invention to provide a signaling device which is easily transferable from the handle of one ski tow rope to another.

Other objects, features and advantages of the present invention. will become apparent from reading the following detailed description of the invention and claims in view of the appended drawings.

DETAILED DESCRIPTION

Figure 1:
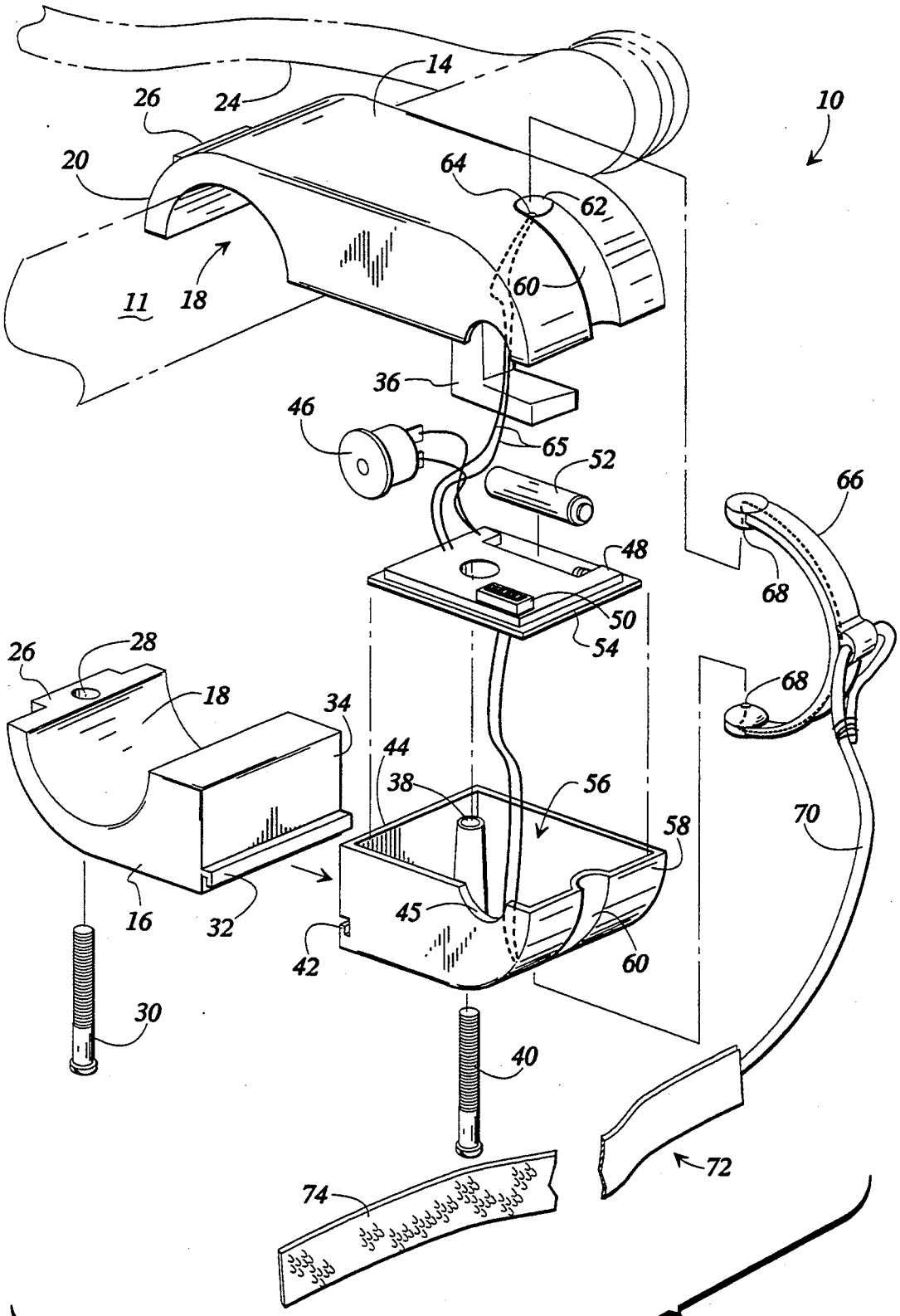
FIG. 1 is an upper and right exploded perspective view of a casing for a transmitter releasably attachable to a handle of a ski tow rope.

Referring now in more detail to the drawings, in which like numerals indicate like parts, FIG. 1 shows an upper and right perspective exploded view of a signal device 10 constructed in accordance with the present invention for removably attaching to a handle 11 of a ski tow rope.

The signal device 10 comprises a casing with an upper housing 14 that matingly joins to a pair of lower housings 16 and 17. The two housings 14 and 16 define a passageway 18 at a first end 20 of the signal device 10. The handle 11 of a ski tow rope 24 passes through the passageway 18 by being captured between the two housings 14 and 16 as they are matingly joined together. A flange 26 at the first end 20 of the signal device 10 includes a threaded bore 28 for receiving a screw 30 to rigidly join the housings 14 and 16 together. A hook-like flange 32 having an L-shape extends out and downwardly from a second end 34 of the housing 16, for a purpose discussed below. In an alternate embodiment (not illustrated) the lower housing 16 pivotally joins to the upper housing 14 at the end 34. A latch on the flange 26 couples the open end 20 of the housings together to capture the handle 11 in the passageway 18.

The upper housing 14 includes a downwardly extending post 36 which includes a threaded bore. The post 36 aligns with a second post 38 that extends upwardly from the lower housing 17. A screw 40 extends upwardly through the posts 38 and 36 to rigidly connect the upper housing 14 to the lower housing 17.

A hook-like flange 42 having an L-shape extends out and upwardly from a first end 44 of the housing 17. The flange 42 matingly engages the flange 32 when the housing 17 is connected to the upper housing 14. The flanges 32 and 42 increase the rigidity of the lower housings 16 and 17 when the signal device 10 is assembled. In an alternate embodiment (not illustrated) the lower housings 16 and 17 are a single member.

A notch 45 in the side of the housing 17 receives a button switch 46 operatively connected to a transmitter 48 held in the housing 17. The switch 46 is preferably a momentary-on switch which closes a circuit only when being depressed by the skier. The skier presses the switch 46 to communicate a signal to the operator of the boat. For example, one press may signal accelerate or go; two presses may signal slow or stop. The transmitter 48 is of conventional construction, such as a type typically employed for operation of an automatic garage door. Such a transmitter has a plurality of code switches 50 for placing in one of two positions. The switches 50 are selectively set to tune the transmitter so that the signals broadcast thereby are receivable by a like-tuned receiver (discussed below). A battery 52 provides a supply of power to operate the transmitter 48.

It will be understood by those skilled in the art that the transmitter 48 is a low powered transmitter which operates on the frequencies assigned by the Federal Communications Commission, or other appropriate government agency responsible for such. The signal of the transmitter 48 does not carry any appreciable distance, for example, the length of a typical tow rope, but is sufficient to be received by a receiver in the boat towing the skier.

A gasket 54 extends around the mating edges of the upper housing 14 and the lower housing 17 for sealing the chamber 56 in which the transmitter 48, battery 52 and switch 46 are disposed. The gasket 54 prevents entry of water into the chamber 56.

A second end 58 of the signal device 10 includes a shallow trough 60 in the outside surfaces of the upper housing 14 and the lower housing 17. A detent 62 is formed at a distal end of the trough 60 in each housing 14 and 17. The detent in the lower housing 17 is not illustrated. An electrical contact 64 is mounted in each of the detents 62. The electrical contacts 64 communicate through wires 65 with the transmitter 48.

A C-shaped clip 66 matingly attaches to the signal device 10 by nesting in the trough 60. The clip 66 has an arc with a radius slightly less than that for the arcuate trough. The clip 66 is thereby biased into the trough 60 for retaining the clip therein. A tab 68 projects from each distal end of the clip 66. The tabs 68 are received in a respective one of the detents 62 to further hold the clip 66 in the trough 60. The tabs 68 also are electrically conductive and are connected by a wire embedded in the clip 66. The tabs 68 each make electrical contact with one of the contacts 64 in the respective detents 62. The clip 66 is positioned on the casing so that the tabs 68 communicate with the contacts 64. This closes a circuit which holds a switch 67 (see FIG. 3) such as a relay in a first position. Removal of the clip 66 opens the circuit and the switch 67 moves to a second position. The switch then closes a second circuit and activates the transmitter.

In an alternate embodiment (not illustrated) a pivotable switch is mounted in at least one of the detents 62 for pivotable movement from a first position to a second position. The tab 68 in this embodiment is not electrically communicative, but pushes the switch into the first position. When the clip 66 is detached from the signal device 10, the switch 64 moves to a second position to activate the transmitter.

In an alternate embodiment, the contact 64 comprises two spaced-apart contacts in electrical communication with the transmitter. The tab 68 in the clip 66 electrically communicates between the two spaced-apart contacts to close the first circuit. In this embodiment, the second contact 64 is not required.

A short lanyard 70 attaches at one end to the clip 66. The distal end 72 of the lanyard 70 connects to the skier. In the illustrated embodiment, the distal end 72 terminates in an adjustable strap 74 which loops around the wrist of a skier. The strap 74 is preferably made of a hook and latch type material so that the loop adjustably fits the wrist of different skiers. In an alternate embodiment (not illustrated) the distal end 72 terminates in a snap hook which attaches to a life jacket worn by the skier.

Figure 2:
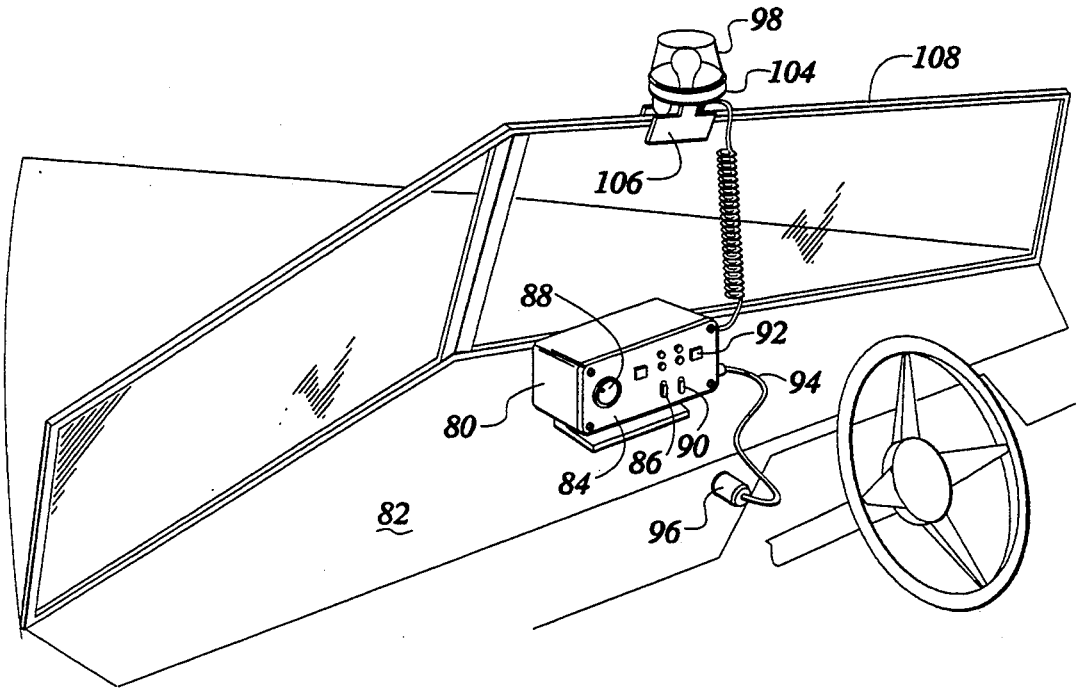
FIG. 2 is a perspective view of a receiver and strobe light attached to a boat for using the removably attachable housing illustrated in FIG. 1.

With reference to FIG. 2, the removably attachable ski signal device 10 operates in conjunction with a receiver 80 which attaches to a dashboard 82 of the ski boat. A plurality of suction cups (not illustrated) extend from the bottom of the receiver 80 for securing the receiver to the dashboard. The receiver 80 includes a control panel 84 on which is mounted a reset switch 86, a speaker 88, an on-off switch 90, and a pilot light 92. The speaker 88 may be a transducer horn to emit an sound for signaling or alerting the operator of the ski boat.

A cable 94 connects the receiver 80 to a source of power, such as the cigarette lighter 96. In an alternate embodiment, the receiver 80 is operated with batteries (not illustrated). The on-off switch 90 is connected with wires to the source of power and to the pilot light 92 so that a visible indicator shows that the receiver 80 is operational. The light 92 is not lit when the on-off switch 90 is set in the off position.

Figure 3:
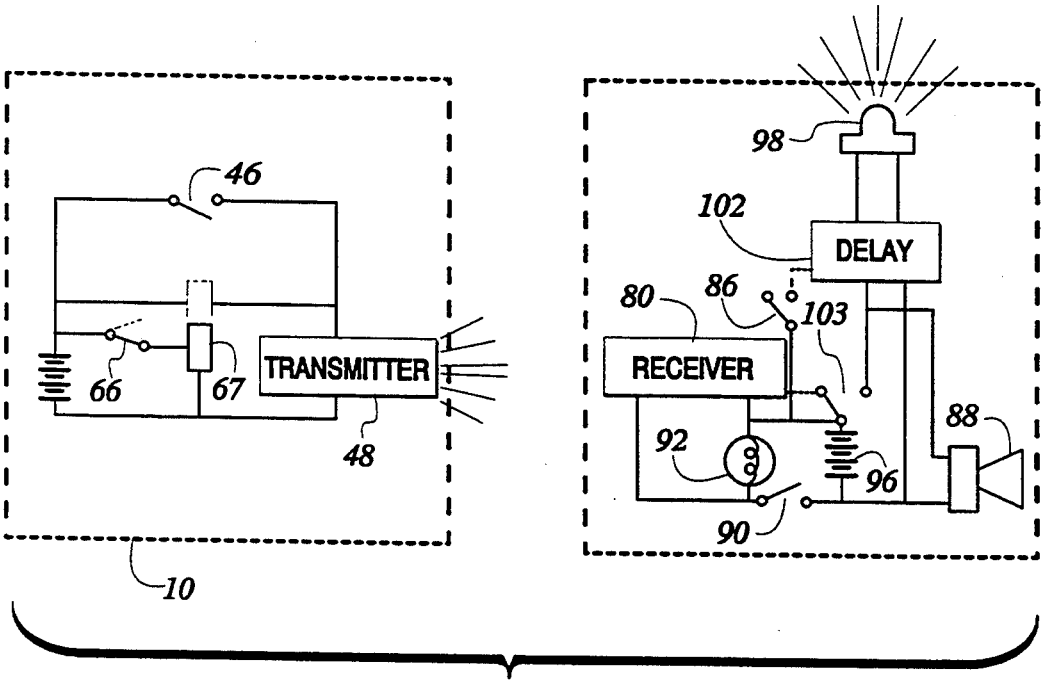
FIG. 3 is a schematic diagram of the transmitter and receiver of the ski tow signaling device illustrated in FIGS. 1 and 2.

A strobe light 98 connects to the receiver 80 through a time delay 102 in parallel with the horn 88 (see FIG. 3.) The time delay 102 operatively connects (illustrated with a dashed line) to the separate reset switch 86. When the receiver receives a signal, the switch 103 is closed. Closing the switch 103 causes the horn 88 to sound immediately. The strobe light 98 will be lighted after the switch 103 has been and remains closed for a predetermined period. The reset switch 86 connects the strobe light 98 with the supply of power independently of the switch 103 so that the horn 88 can be turned off with the strobe light continuing to operate.

The strobe light 98 is enclosed in a transparent or translucent dome having a frustoconical or other appropriate shape. The dome has an open-bottom, and is removable received on a base 104 which carries the bulb and socket for the strobe light. The base 104 is provided on its bottom surface with a pivotable clamp 106 which connects to the base 104. The clamp 106 is biased by a spring to a closed position. The strobe light 98 is, therefore, removably mountable on suitable portions of the boat such as the upper edge of a windshield frame 108 for the boat as illustrated in FIG. 2. The strobe light 98 accordingly is mounted as high as possible on the boat, to provide a clear signal to other boaters in the area.

With reference to FIG. 1, the ski signal device 10 is used by first installing the removably attachable casing on the handle 11 of a ski tow rope 24. The casing is separated into the upper housing 14 and the lower housing 16 by removing the screw 30 from the bore 28. (The code switches 50 in the transmitter 48 and the receiver 80 are set alike so that the two can communicate.) The upper housing 14 is then placed on the handle 22. The handle 22 slides into the partial passageway 18 at the first end 20 of the signal device 10. The lower housing 16 is placed under the handle 22. The hook-like flange 32 slidably engages the flange 42 on the second lower housing 17. The lower housing 16 is brought into engagement with the upper housing 14 while surrounding the handle 22 to define the passageway 18. The screw 30 is threaded into the bore 28 for rigidly connecting the upper housing 14 and the lower housing 16 together. In an alternate embodiment (not illustrated) a resilient pad such as made of foam or rubber, is disposed between the wall of the passageway and the handle to cushion shocks and bumps. The clip 66 is positioned in the channel 60 of the housings 14 and 17 so that the tabs 68 make electrical contact with the contacts 64 in the detents 62. The switch 67 is thereby biased to a first position.

The receiver 80 is positioned on the dashboard 82 of the boat, as illustrated in FIG. 2, and the power card 94 connected. The strobe light 98 is clamped to the windshield 108. The on/off switch 90 is switched on and the pilot light 92 is thereby lit.

The skier in the water puts on the skies. The skier then wraps the strap 74 around one wrist. The boat operator is signalled to start the boat by the skier depressing the button switch 46 a predetermined number of times. With reference to FIG. 3, the switch 46 closes momentarily and activates the transmitter 48. The transmitter 48 emits a radio signal which is received by the receiver 80. The switch 103 is moved to sound the horn 88 in response to the signal sent by the skier, thereby communicating with the operator of the boat.

When the skier falls off or drops a ski, the arm of the skier moves away from the handle 11. The short lanyard 70 is thereby pulled and this detaches the clip 66 from engagement with the detents 62. The electrical circuit is opened and this cuts power to the switch 67. The switch 67 moves from the first position to the second position. In the second position, the switch 67 closes a second circuit which activates the transmitter 48.

In an alternate embodiment (not illustrated), the switch 67 is responsive to a pressure-sensitive arm extending outwardly from the housing. The arm is gripped by the skier to bias the switch 67 in the first position. When the skier falls and releases the handle, the arm moves the switch 87 to the second position to activate the transmitter.

The activated transmitter 48 emits a radio signal. The receiver 80 receives the signal from the transmitter 48, and in response the switch 103 is closed. The horn 88 emits an audible tone to alert the operator of the boat. After a delay period, the strobe light 98 is lit, thereby alerting other boaters of the presence of a skier in the water. When the operator of the boat maneuvers the ski handle to the skier, the clip 66 is replaced in the trough 60. This closes the first circuit, causing the switch 67 to move to the first position. The transmitter 48 thereby stops transmitting. The receiver opens the switch 103 to silence the horn 88. After the skier is ready to go again, the reset switch 86 is opened to switch off the strobe light 98. One of ordinary skill in the art will readily appreciate that the circuit could be modified to automatically silence the horn 88 after a brief period, such as several seconds, leaving only the strobe light 98 operating to alert other boaters.

The signal device 10 according to the present invention provides a removably attachable transmitter for increasing the safety of water skiers which is readily transportable to other boats and ski ropes. The signal device 10 is readily and easily transferred to a new handle or ski rope, should either the handle or rope break during skiing.

While skiing, a water skier can communicate prearranged codes to the operator of the ski boat by pressing the button switch 46 momentarily. Should the skier fall, the lanyard 70 attached to the wrist pulls the clip 66 from the casing of the transmitter 48. The switch 64 moves to its second position to activate the transmitter and thereby communicate both an audible and visual signal to the boat operator and others in the area that the skier is in the water.

The specification has thus described various embodiments, including a preferred embodiment, of the present invention, including the assembly and use thereof. it is to be understood, however, that numerous changes and variations may be made in the construction of the present invention. It should therefore be further understood that modification of the present invention may be made without departing from the scope thereof as set forth in the appended claims.

I claim:

1. A signaling device, comprising:

a casing comprising an upper housing matingly joinable to a lower housing to define at a first end a passage for receiving therethrough a handle for a ski tow rope;

means for securely joining the lower housing and the upper housing together;

a C-shaped clip detachably received at a second end of the casing and operatively engaged to at least one switch biased to a first position and movable to a second position in response to separation of the clip from the casing;

means for coupling the clip to a skier, whereby a water skier, having fallen into the water during skiing, separates the clip from the casing which moves the switch to the second position; and means responsive to the switch being in the second position for sending a signal.

2. The signaling device as recited in claim 1, wherein means for securely joining comprises at least one screw connecting the upper and lower housings together.

3. The signaling device as recited in claim 1, wherein means for coupling comprises a strap connected at a first end to the clip and removably attachable at a second end to a water skier whereby the skier falling into the water pulls on the strap to separate the clip from the casing.

4. The signaling device as recited in claim 1, wherein means for sending comprises:

a transmitter and antenna; and a power supply.

5. The signaling device as recited in claim 1, wherein:

the casing defines at least one detent in which the switch is held; and the clip includes a projecting tab received in the detent to hold the switch in the first position.

6. A signaling device for removable attachment to a handle of a ski tow rope for use with a receiver in a boat for communicating between a skier and an operator of a boat, comprising:

an upper housing matingly joinable to a lower housing to define a passageway for receiving therethrough the handle of the ski tow rope;

a screw threadingly engaged in a bore to rigidly connect the upper housing to the lower housing;

a C-shaped clip detachably received in a trough in the upper and lower housing for biasing to a first position a switch operatively connected to a transmitter held in the housings;

a lanyard connected to the clip with a strap at a distal end for attaching to a skier, and whereby the skier, having fallen into the water and released from the handle, pulls the clip from the trough to move the switch to a second position and the transmitter, responsive to the switch being moved to the second position, emits a signal to the receiver.

7. The signaling device as recited in claim 6, wherein:

the upper and lower housings each include a detent at the distal end of the trough in each housing; and the clip includes a tab extending readily inwardly at the distal ends of the clip for mating engagement with a respective one of the detents.

8. The signaling device as recited in claim 7, wherein the clip includes at least one contact which electrically communicates with the transmitter.

9. The signaling device as recited in claim 6, wherein the clip has a radius less than that of the trough in the upper and lower housing, whereby the clip is biased to be held in the trough.

10. The signaling device as recited in claim 6, wherein the strap is a hook-and-latch material for adjustable wrapping around the wrist of the skier.

* * * * *